United States Patent [19]

Kimura

[11] Patent Number: 4,591,760

[45] Date of Patent: May 27, 1986

[54] CATHODE RAY TUBE APPARATUS

[75] Inventor: Masamichi Kimura, Ibaraki, Japan

[73] Assignee: Matsushita Electronics Corporation, Kadoma, Japan

[21] Appl. No.: 592,008

[22] Filed: Mar. 21, 1984

[30] Foreign Application Priority Data

Mar. 25, 1983 [JP] Japan ..... 58-50630
Jul. 20, 1983 [JP] Japan ..... 58-133171

[51] Int. Cl.[4] ..... H01J 29/46; H01J 29/56

[52] U.S. Cl. ..... 315/16; 313/449

[58] Field of Search ..... 315/14, 15, 16; 313/449

[56] References Cited

U.S. PATENT DOCUMENTS 3,143,685 8/1964 Glyptis ..... 315/15
3,806,758 4/1974 Lundqvist ..... 315/382
4,383,199 5/1983 Washino et al. ..... 315/15
4,481,445 11/1984 Gorski ..... 313/449

FOREIGN PATENT DOCUMENTS 55-105350 7/1980 Japan .
55-120066 8/1980 Japan .
57-30247 2/1982 Japan .

*Primary Examiner*—Theodore M. Blum
*Attorney, Agent, or Firm*—Cushman, Darby & Cushman

[57] ABSTRACT

An electron gun has five grids ($G_1$, $G_2$, $G_3$, $G_4$, $G_5$), and an additional grid ($G_{2s}$) is disposed between the second grid and the third grid ($G_3$) and is impressed with a potential lower than that of the second grid ($G_2$), and a trimming electrode ($G_{5a}$) with a trimming aperture 14 is provided in the fifth grid ($G_5$), and by trimming the outer shell part of the electron beam having crossed the electron gun axis twice a very small beam spot is produced.

20 Claims, 14 Drawing Figures

VERTICAL DEFLECTION

HORIZONTAL DEFLECTION

FIG. 5 (a) (Prior Art)

(a)
(Prior Art)

(b)
(Prior Art)

(c)
(Prior Art)

CATHODE RAY TUBE APPARATUS

BACKGROUND OF THE INVENTION

1. Field of the Technology

The present invention relates generally to a cathode ray tube, and particularly concerns a cathode ray tube apparatus of high resolution power suitable for displaying graphic and Chinese character displaying.

2. Description of the Prior Art

Cathode ray tubes for use in graphic displaying or Chinese character displaying requires specially high resolution power. Hitherto, raising of anode potential or enlarging diameter of electron gun have been tried for improving the resolution. However, the former induces undesirable radiation of x-ray emission and the latter results in increase of deflection power, resulting in high cost.

Published Japanese Unexamined Application No. Sho 57-30247 discloses a cathode ray tube apparatus, wherein an electron beam crosses the axis of the electron gun twice, firstly at a region of a prefocus lens, and secondly before incidence to a main lens. Spherical aberration at the main lens is thus decreased, resulting in a high resolution. The above-mentioned application has a problem that, while a high resolution is obtainable for a high electron beam operation, in a low electron beam operation for a low luminance displaying the improvement of resolution is not achieved but rather induces poor resolution since electron beam only from circumference part of the emitting face 2 crosses the electron gun axis twice.

SUMMARY OF THE INVENTION

Accordingly, a purpose of the present invention is to provide a cathode ray tube capable of high resolution even for small beam current region, while using electron gun of the above-mentioned twice-crossing type.

The cathode ray tube apparatus in accordance with the present invention includes an electron gun for producing an electron beam, a fluorescent screen to be impinged by the electron beam, and an evacuated enclosure enclosing the electron gun and the fluorescent screen therein.

the electron gun includes at least a pre-triode part having a cathode, a first grid as a control grid, and a second grid on which an accelerating potential is to be applied.

Also, a main lens part, wherein an additional grid is disposed between the pre-triode and the main lens part, and impressed with a potential which is lower than the potentials of the second grid, is part of the cathode ray tube of the present invention. As a result, a substantial part of the electrons emitted from the cathode toward the main lens cross the electron gun axis twice.

Also, a trimming electrode is disposed in a region of the main lens for trimming a circumferential part of the electron beams passing therethrough toward the fluorescent screen.

The cathode ray tube apparatus in accordance with the present invention can alternatively include an electron gun for producing an electron beam, a fluorescent screen to be impinged by the electron beam and an evacuated enclosure enclosing the electron gun and the fluorescent screen therein.

The electron gun in this alternative embodiment includes a pre-triode part having a cathode, a first grid as a control grid and a second grid, and a main lens part.

However, an additional grid is provided between the pre-triode and the main lens, which is impressed with a potential which is lower than the potentials of the second grid and is varied responding to degree of deflection of the electron beam. Thereby, a substantial portion of the electrons emitted from the cathode toward the main lens is focused in a manner so that they cross the electron gun axis twice.

Also, a trimming electrode is disposed in an inside hollow space of the main lens for trimming a circumferential part of the electron beams passing therethrough toward the fluorescent screen.

BRIEF DESCRIPTION OF DRAWING

FIG. 2(*b*) is a graph showing a characteristic curve between horizontal deflection and potential impressed on a subsidiary second grid $G_{2s}$.

FIG. 5(*a*) is a graph showing characteristics between angle r' and the spherical aberration $\rho$ taking r as parameter.

DESCRIPTION OF THE PREFERRED EMBODIMENT

Figure 1:
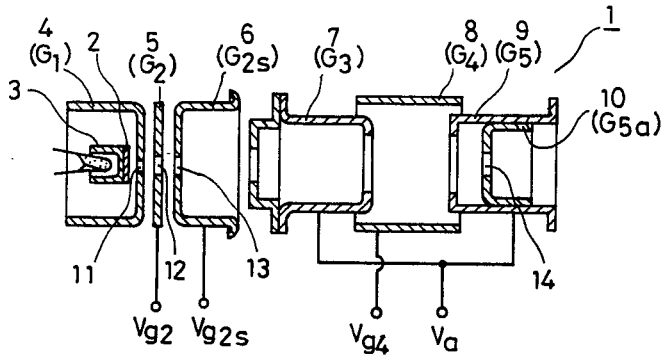
FIG. 1 is a sectional elevation view of a cathode ray tube embodying the present invention.

A preferred embodiment in accordance with the present invention is described by taking a uni-potential type cathode ray tube apparatus as an example. In FIG. 1, which is a sectional elevation view of an essential part of the cathode ray tube apparatus in accordance with the present invention, an electron gun 1 comprises a cathode 3 having an electron emitting face 2, a first grid $G_1$ as a control electrode 4, a second grid $G_2$ as an accelerating electrode 5, an additional grid $G_{2s}$ as a subsidiary shield electrode 6, a third grid $G_3$ as a first anode 7, a fourth grid $G_4$ as a focusing electrode 8, a fifth grid $G_5$ as a second anode 9 and another grid additional to the fifth grid $G_{5a}$ as a trimming electrode 10. In a best mode embodiment, electron beam passing apertures 11, 12 and 13 provided on the active faces of the $G_1$ grid 4, $G_2$ grid 5 and $G_{2s}$ grid 6 are all 0.4 mm diameter, and thicknesses of the part around the aperture of the $G_1$ grid 4 is 0.065 mm, that of $G_2$ grid 5 is 0.25 mm and that of $G_{2s}$ grid is 0.2 mm, respectively. Inside diameter of the $G_4$ grid 8 is 8.7 mm, gap between the electron emitting face 2 and the $G_1$ grid 4 is 0.07 mm, effective gap between the $G_1$ grid 4 and the $G_2$ grid 5 is 0.43 mm, gap between the $G_2$ grid 5 and the $G_{2s}$ grid 6 is 0.4 mm, distance between $G_{2s}$ grid 6 and $G_3$ grid 7 is 3.2 mm, and diameter of trimming aperture 14 of the trimming electrode 10 is 0.8 mm. As material of the trimming electrode 10, tantalum is suitable, since tantalum has a high melting point with low vapor pressure, and therefore has a high resistivity against temperature rise due to electron beam bombardment, and also tantalum has a good weldability.

Figure 2A:
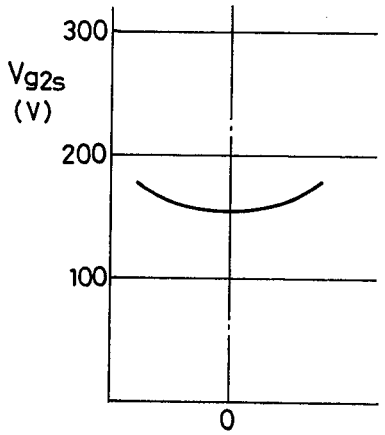
FIG. 2(*a*) is a graph showing a characteristic curve between vertical deflection and potential impressed on a subsidiary second grid $G_{2s}$.
Figure 2B:
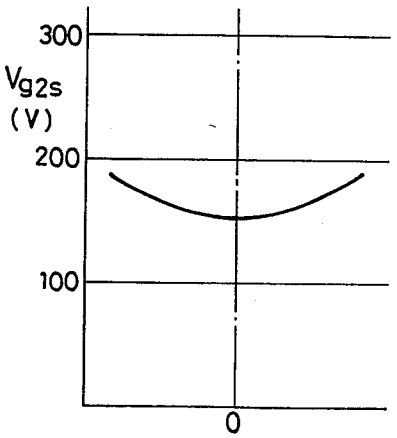
Figure 3:
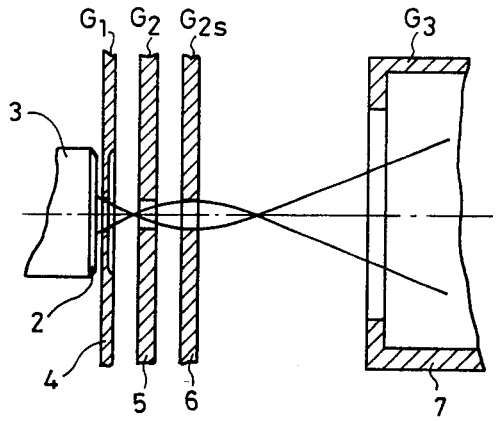
FIG. 3 is an enlarged sectional elevation view showing behavior of electron beam in the embodiment shown in FIG. 1, FIG. 2(*a*) and FIG. 2(*b*).

Experimental studies show that: the diameter of the trimming aperture 14 is preferably about 2 times of the diameter of the aperture 11 of the $G_1$ grid 4, and for a larger diameter of the trimming aperture 14 the electron beam trimming effect is not satisfactory, thereby leaving a considerable spherical aberration. For smaller trimming aperture 14 the electron beam current becomes too small; the effective gap between the $G_1$ grid 4 and the $G_2$ grid 5 is preferably in a range of 1.0–1.5 times the diameter of the aperture 11 of the $G_1$ grid 4, since in this range a satisfactory matching of emittances and acceptance in a phase space diagram is obtainable; the gap between the $G_2$ grid 5 and active face of the $G_{2s}$ grid 6 is preferably about the same as the diameter of the aperture 11 of the $G_1$ grid 4, and the distance between the active face of the $G_{2s}$ grid 6 and the active face of the $G_3$ grid 7 is preferably in a range of 5.0–10 times the diameter of the aperture 11 of the $G_1$ grid 4, for achieving good matching between the emittance and the acceptance. Furthermore, distance $Z_k$ between the electron emitting face 2 of the cathode and center of the main lens is preferably 17.27 mm; and distance $Z_s$ between the center of the main lens and the phosphor screen is preferably 213.4 mm. Potential of the $G_{2s}$ grid 6 is preferably lower than half of the potential $V_{g2}$ impressed on the $G_2$ grid 5, and besides, a dynamic voltage $V_{g2s}$ which is changed responding to amount of vertical deflection or amount of horizontal deflection as shown in FIG. 2(*a*) or in FIG. 2(*b*), respectively, is impressed on the $G_{2s}$ grid 6. In such cathode ray tube apparatus, the electron beam trajectory becomes as shown in FIG. 3.

The cathode ray tube apparatus constituted as above-mentioned has a resolution which is improved by about 25% in comparison with the conventional cathode ray tube apparatus of the similar uni-potential one.

Figure 5:
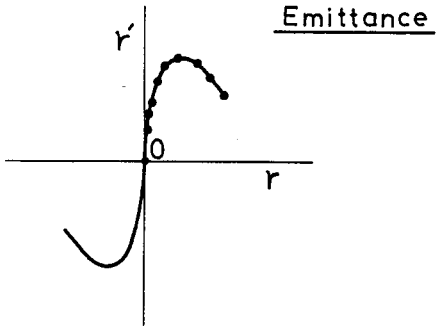
FIG. 5 (Prior Art)
FIG. 5 is a phase-space diagram for emittance.
Figure 5:
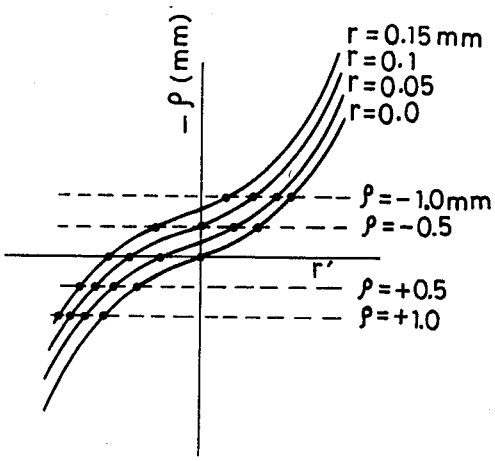
FIG. 5 (Prior Art)

The reason of the improvement of resolution is elucidated hereafter with reference to phase-space diagrams of FIG. 5 and thereafter.

Figure 6:
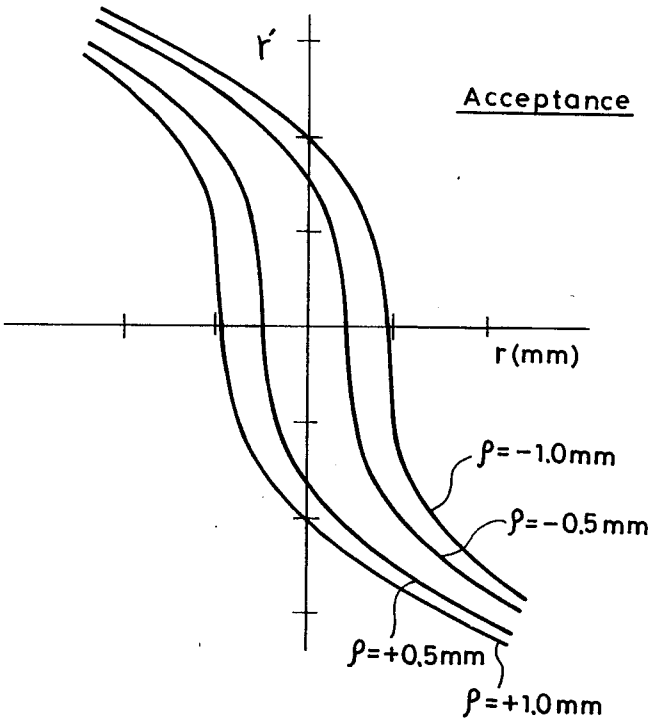
FIG.6 (Prior Art)
FIG. 6 is a phase-space diagram for acceptance.

The phase-space diagram is a convenient means to comprehend behaviors of electron beams, and FIGS. 5 and 6 are emittance diagrams and acceptance diagrams of the phase space diagram for an electron beam. The former is suitable to comprehend behavior of an axially symmetric electron beam emitted from the cathode 3 to the main lens, and the latter is suitable for comprehending the performance of the main lens. It has been found that the size of the beam spot can be estimated by matching the phase space diagrams of the emittance and acceptance by superposing them.

Herein described is an application example of the phase space diagram on the electron beam behavior. As shown in emittance diagram of FIG. 4, an electron beam is emitted from radially divided point i on the electron emitting face 2 of the cathode 3 and travels along electron beam trajectory 15, is refracted in a cathode immersion lens and prefocus lens, and goes straight toward a main lens 16 after passing through the prefocus lens region. This straight beam seems as if it comes straight from a virtual emitting point 17 on the electron emitting base 2 of the cathode 3. This virtual emitting point 17 is defined as a point of crossing of electron gun axis and a straight line extended leftward (18) from the straight line part beyond the cathode.

A graph of FIG. 5 is drawn by plotting points on the phase-space diagram having ordinate graduated by distance r of point from the center of the cathode 3 on the electron beam emitting face 2, and abscissa graduated by differential r' ($r'=dr/dz$, where z is distance from the electron beam emitting face 2 along the axis), which is referred to as angle hereafter for simplicity. The r and r' at virtual emitting points are calculated with a computer and plotted on the phase-space diagram, and an example of emittance diagram is shown in FIG. 5.

An acceptance diagram is drawn as follows. Acceptance represents a range in phase-space diagram in which spot size is within a certain value in consideration of main focus lens characteristics. Radial spherical aberration $\rho$, appearing on the phosphor screen is calculated with a computer for a given condition on the main lens, distance from cathode lens, distance from the main lens to screen, r and r'. Relation between $\rho$ and r' is shown in FIG. 5(*a*). Taking r as parameter four selected values of $\rho$, for instance, $\rho=-1.0$ mm, $\rho=-0.5$ mm, $\rho=+0.5$ mm, $\rho=+1.0$ mm, . . . , and values of r and r' for respective curves for the above-mentioned values of $\rho$ are calculated. Combinations of r and r' to yield selected constants $\rho$ are plotted on phase-space diagram of r and r' taking the spherical aberration $\rho$ as parameter, as shown in FIG. 6. The combinations of r and r' plotted on the phase-space diagram means acceptance.

Spot size is estimated from emittance and acceptance by superposing the emittance and the acceptance diagrams. The superposing of the two diagrams means taking a matching to find optimum condition. For instance, when all of emittance is in such a range of acceptance as $\rho=-0.5$ mm$\leqq\rho\leqq+0.5$ mm, diameter of the beam spot is estimated as 1.0 mm. Similarly, when the superposed diagram shows that all of the emittance is in a range of acceptance as $\rho=-1.0$ mm$\leqq\rho\leqq+1.0$ mm, diameter of the beam spot is estimated to be 2.0 mm.

Figure 7:
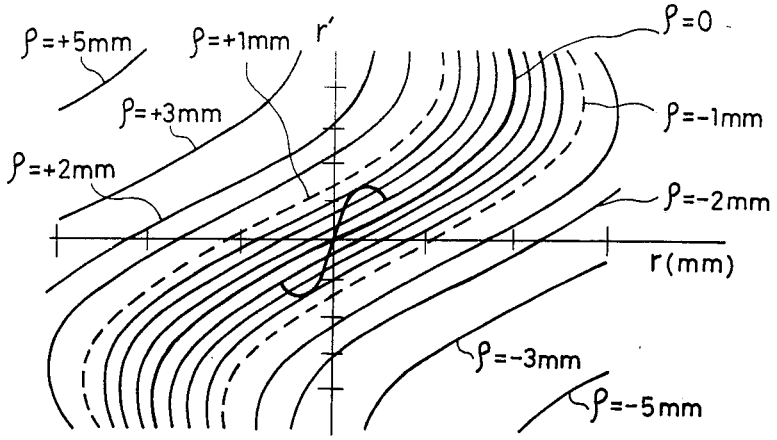
FIG. 7(*a*), FIG. 7(*b*) and FIG. 7(*c*) are phase-space diagram for matching of emittances and acceptances wherein FIG. 7(*a*) is an operation with a high focusing potential, FIG. 7(*b*) is for an operation with a low focusing potential, and FIG. 7(*c*) is for an operation with an appropriate focusing potential.
Figure 7:
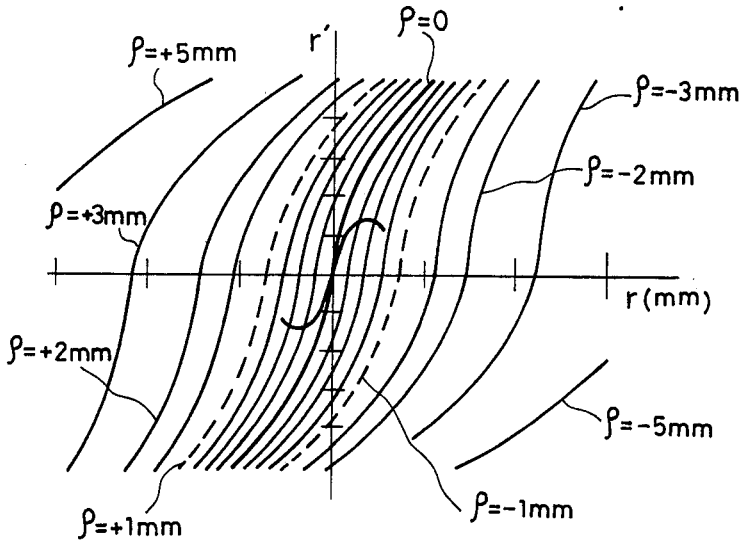
Figure 7:
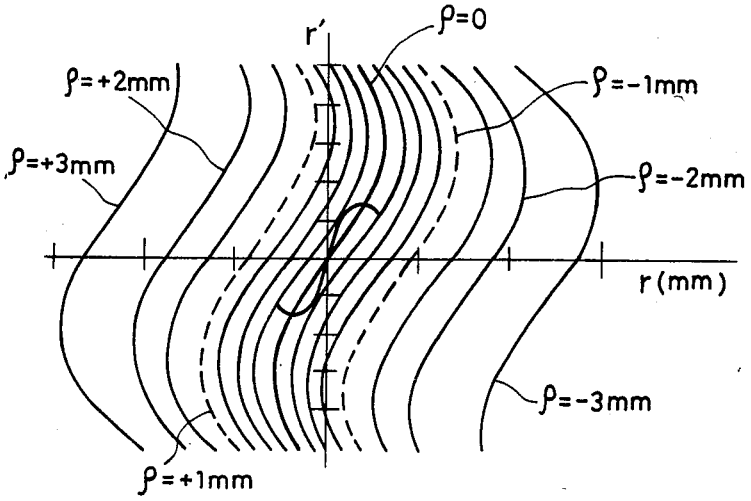

FIG. 7(*a*), FIG. 7(*b*) and FIG. 7(*c*) show three cases of the matching diagrams, wherein FIG. 7(*a*) is the case where potential of the focusing electrode 8 is too high, FIG. 7(*b*) is that the potential is too low, and FIG. 7(*c*) is that the potential is appropriate. As shown in FIG. 7(*a*), when the emittance rise in such a range that $\rho$ is only positive for the positive value of r, the beam spot becomes extraordinarily large. This is because, due to the excessively high focusing potential, the main lens function is weak. Alternatively, when the emittance rise is in a region where $\rho$ is negative as shown in FIG. 7(*b*) due to excessively low focusing potential, the main lens function becomes too strong, and this also makes the spot large. When the focusing potential is appropriate as shown in FIG. 7(*c*), the emittance rise ranges half in positive $\rho$ value and half in negative $\rho$ value. Accordingly, by preparing a number of acceptance diagrams for various focusing potentials, matching with emittance diagram is selected so as to find optimum matching, and thereby optimum focusing potential and beam spot diameters for such condition can be estimated.

Figure 8:
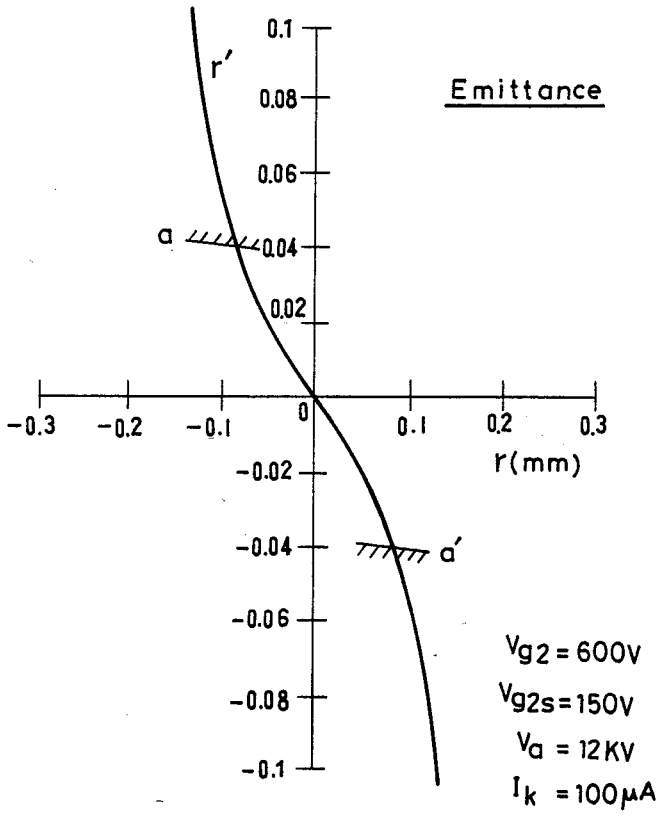
FIG. 8 is a phase-space diagram for emittance of an embodiment in accordance with the present invention.

FIG. 8 is an emittance diagram drawn by calculating trajectory of a cathode ray tube apparatus embodying the present invention described referring to FIG. 1, FIG. 2 and FIG. 3, wherein lines a and a' show trimming aperture 14 of the trimming electrode 10. In this cathode ray tube apparatus, almost all electrons emitted from the electron beam emitting face 2 of the cathode (only excluding the electrons emitted from the central part of the electron beam emitting face) undergo trajectories which cross electron gun axis Z twice. Accordingly, when the distance r is in positive value, all the angles r' become negative, and when the distance r is negative the angles r' becomes positive, as shown in FIG. 8. This is quite different from the emittance diagram of the conventional cathode ray tube emittance as shown in FIG. 5.

The embodiment apparatus comprises the trimming electrode 10 having the trimming aperture 14 of 0.8 mm diameter. Accordingly, such outside shell part of the electron beam as having angle r' of $|r'| \geqq 0.04$ is removed by the trimming aperture 14 when passing there, and the effective electron beam which flows from the main lens toward the screen is about 54% (which percentage is beam permeability) of the whole cathode current. Accordingly for calculation or experiment of the embodiment apparatus, the cathode current $I_k$ is selected to be 100 $\mu$A which is about two times of the conventional whole cathode current of about 50 $\mu$A of the conventional cathode ray tube apparatus.

Figure 9:
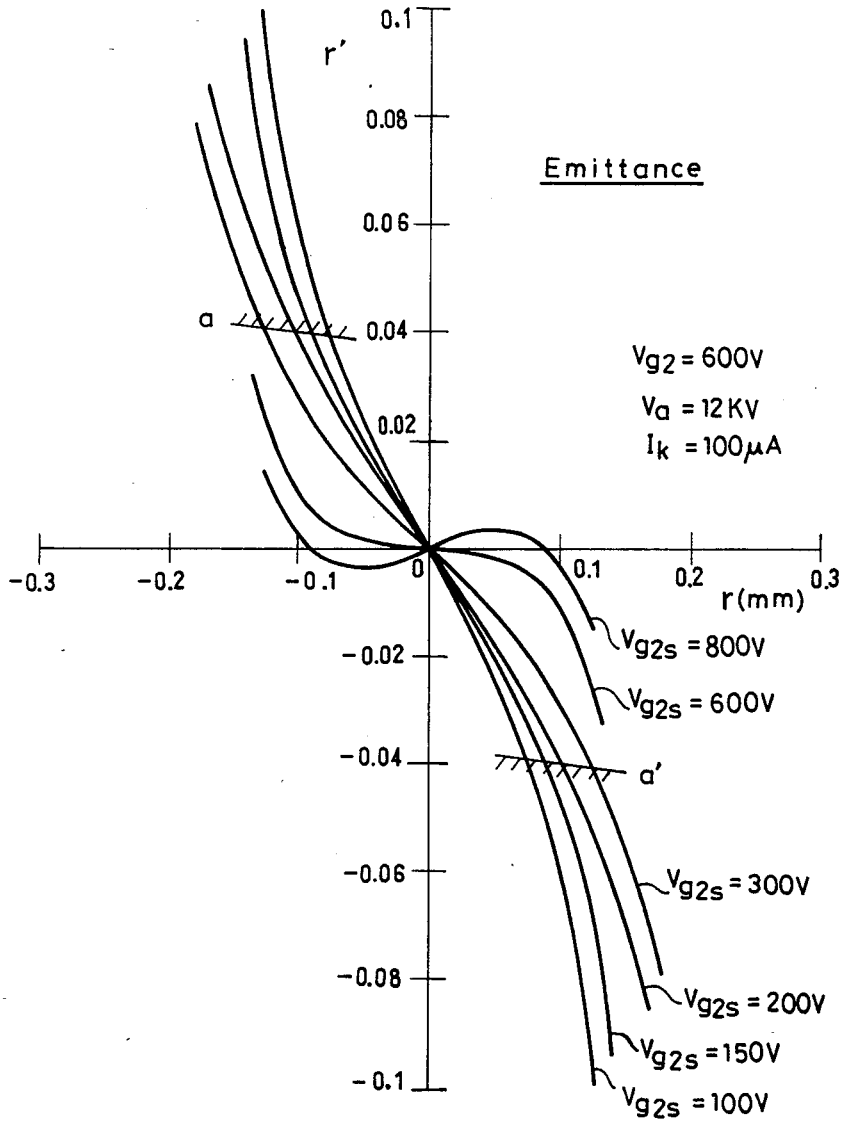
FIG. 9 is a phase-space diagram for emittances taking potentials of subsidiary second grid $V_{g2s}$ as parameter.

FIG. 9 is an emittance diagram drawn taking potential ($V_{g2s}$) of the subsidiary second grid as parameter. When the potential ($V_{g2s}$) is low, the angle r' of the electron beam, namely the divergence angle, increases and permeability of the electron beam passing through the trimming electrode decreases, and therefore the potential ($V_{g2s}$) of the subsidiary second grid is preferably as high as possible. However, when $Z_k = 17.27$ mm, $V_{g2s}$ to make the beam spot diameter minimum is in the range of 100 V–150 V. Accordingly in this example operation, the potential $V_{g2s}$ is selected as $V_{g2s} = 150$ V for operation at deflection angle 0.

Figure 10:
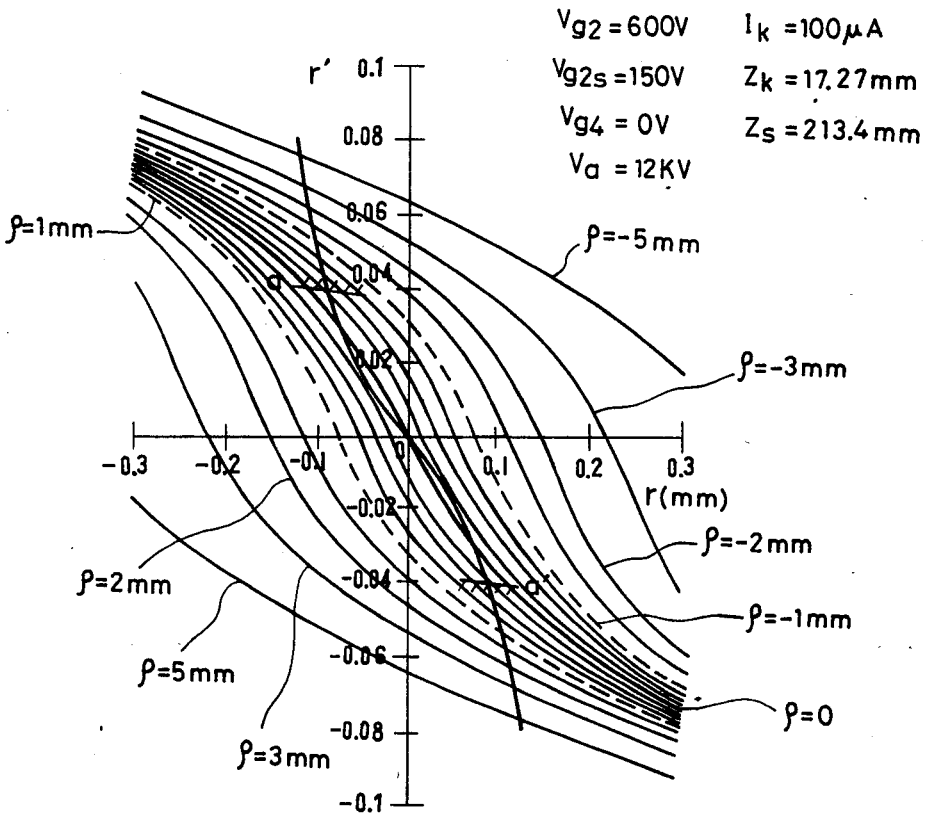
FIG. 10 is a phase-space diagram for matching emittances and acceptance in the embodiment of the present invention.

FIG. 10 is a matching diagram which is made by superposing the the phase space diagrams of emittance diagram and acceptance diagram for the condition of $V_{g2s} = 150$ V. In this matching diagram, emittances which are cut by the trimming aperture 14 of the trimming electrode is limited within the range of $\rho$ of $-0.175$ mm$\leqq \rho \leqq +0.175$, and accordingly under the condition of $V_{g2s} = 150$ V the diameter of the beam spot becomes so small as 0.35 mm, achieving a very high resolution.

Figure 4:
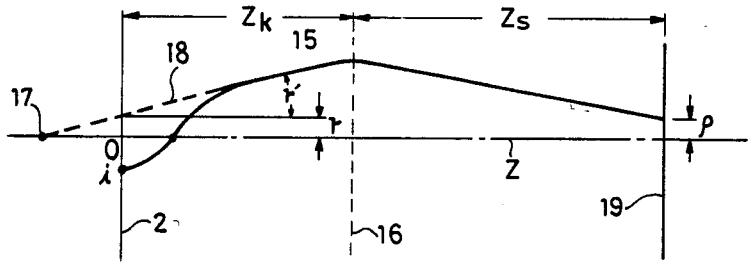
FIG. 4 (Prior Art)
FIG. 4 is a graph schematically showing electron beam trajectory of a cathode ray tube apparatus of a prior art.

Under the conventional configuration of FIG. 4, wherein almost part of the electron beam crosses the electron gun axis only once, has majority part of electrons running in parallel to the electron gun axis. That means, in the conventional electron gun (not shown) in an emittance diagram, the angle (r') becomes $r' = 0$ when r does not take the value 0. That is, the curves of the emittance diagram do not cross the r-axis (abscissa) at point 0.

As shown in FIG. 7(*a*), FIG. 7(*b*) and FIG. 7(*c*), even though the focussing potentials are changed, the point where the curve of $\rho = \pm 0.25$ mm cross the r-axis do not substantially change. Accordingly under a condition that the emittance curves do not cross the r-axis at point 0, it is difficult to confine the emittance in the range of $-0.25$ mm$\leqq \rho \leqq +0.25$ mm. Therefore, to obtain a beam spot of very small diameter is difficult. Accordingly in the present invention, the improvement is that most electrons emitted from the electron emitting face 2 of the cathode are made to cross the electron gun axis two times as has been described. It is to be noted, as shown in FIG. 9, when the potential $V_{g2s}$ is of a value close to the potential $V_{g2}$ (600 V), the electrons which travels parallel to the electron gun axis increase, the potential $V_{g2s}$ should be selected lower than the potential $V_{g2}$. Furthermore, the intended effect of trimming the outer shell part of the electron beam is only effective in the present invention. That is, if such trimming of the outer shell part of the electron beam is done in the apparatus of the prior art such as of FIG. 4, the emittance of $\rho = 0$ (spherical aberration is zero) has a large value of r' as shown in FIG. 7(*c*), the electron beam of the part having large angle (r') which is to be focussed to the central part of the beam spot is undesirably trimmed, thereby resulting in undesirable brightness distribution of the beam spot (center of the beam spot becomes dark, making a doughnut type beam spot) while beam spot diameter remains the same.

The advantage of the present invention is that, the trimmed outer shell part of the electron beam in the present apparatus is the electrons of large spherical aberration since the electron beam part from the circumferential part of the cathode surface crosses the electron gun axis twice, and accordingly the trimming improves the spherical aberration without fail, and no deterioration is made. It is confirmed that the permeability to the electron beam of the trimming electrode 10 is preferably 20–60%; when the permeability is smaller than 20% the beam spot becomes too dark, and when permeability is higher than 60% the improvement of diameter of the beam spot is not achievable.

Furthermore, the whole cathode ray current $I_k$ is preferably smaller than 50% of maximum electron beam of the electron gun 1. This is because that, in operations with a larger whole cathode ray current $I_k$ than the above-mentioned 50%, the electron beam becomes not to make twice-crossing for its central component part, thereby inducing a loss of intended effect of the trimming.

The above-mentioned embodiment is of the cathode ray tube apparatus with a uni-potential type electron gun configuration; but the present invention is of course applicable to a cathode ray tube apparatus with bi-potential type electron gun configuration, wherein the second grid functions as an acceleration electrode and the subsidiary second grid $G_{2s}$ functions as auxiliary acceleration electrode.

The cathode ray tube apparatus in accordance with present invention can produce beam spot of very small diameter and good brightness distribution both for large beam current operation range and small beam current operation range, thereby achieving good resolution. Furthermore, when the potential to be applied to the additional second grid $G_{2s}$ 6 is changed corresponding to deflection angle, such voltages are fairly low voltage as about 35 V as shown in FIG. 2(*a*) and FIG. 2(*b*) and therefore the driving circuit for such change of the potential becomes rather simple.

What is claimed is:

1. A cathode ray tube apparatus comprising:

electron gun means for producing an electron beam along an axis;

a fluorescent screen to be impinged by said electron beam; and an evacuated enclosure enclosing said electron gun means and said fluorescent screen therein;

said electron gun means comprising:

(a) a pre-triode part having a cathode, a first grid as a control grid, and a second grid on which an accelerating potential is to be applied, (b) a main lens part, (c) an additional grid disposed between said pre-triode and said main lens part, (d) means for impressing a potential on said additional grid which is lower than said accelerating potential of said second grid to focus a substantial part of electrons emitted from said cathode toward said main lens for causing said electrons to cross twice said axis of said electron gun means, and (e) trimming electrode means disposed in a region of said main lens for trimming a circumferential part of electron beams passing therethrough toward said fluorescent screen.

2. A cathode ray tube apparatus in accordance with claim 1, wherein electron beam passing apertures on said first grid and second grid and said additional grid have substantially the same diameters.

3. A cathode ray tube apparatus in accordance with claim 1, wherein a trimming apertures of said trimming electrode has a diameter which is about two times of said diameter of said electron beam passing aperture of said first grid.

4. A cathode ray tube apparatus in accordance with claim 1, wherein said trimming electrode is made of tantalum.

5. A cathode ray tube apparatus in accordance with claim 1, wherein electron beam permeability of said trimming electrode is 20–60%.

6. A cathode ray tube apparatus in accordance with claim 1, wherein said pre-triode part has potentials to issue electron beam current which is lower than 50% of maximum electron beam of said electron gun.

7. A cathode ray tube apparatus in accordance with claim 1, wherein potential of said additional grid is lower than 50% of the potential of said second grid.

8. A cathode ray tube apparatus comprising an electron gun for producing an electron beam along an axis, a fluorescent screen to be impinged by said electron beam and an evacuated enclosure enclosing said electron gun and said fluorescent screen therein, said electron gun comprising:

(a) a pre-triode part having a cathode, a first grid as a control grid and a second grid having a potential thereon;

(b) a main lens part;

(c) an additional grid provided between said pre-triode and said main lens;

(d) means for impressing a potential on said additional grid which is lower than said potential of said second grid and is varied responding to degree of deflection of said electron beam for focusing a substantial part of electrons emitted from said cathode toward said main lens and for causing said electrons to cross said electron gun axis twice, and (e) trimming electrode means disposed in an inside hollow space of said main lens for trimming a circumferential part of electron beams passing therethrough toward said fluorescent screen.

9. A cathode ray tube apparatus in accordance with claim 8, wherein electron beam passing apertures on said first grid and second grid and said additional grid have substantially the same diameters.

10. A cathode ray tube apparatus in accordance with claim 8, wherein a trimming apertures of said trimming electrode has a diameter which is about two times of said diameter of said electron beam passing aperture of said first grid.

11. A cathode ray tube apparatus in accordance with claim 8, wherein electron beam permeability of said trimming electrode is 20–60%.

12. A cathode ray tube apparatus in accordance with claim 8, wherein said pre-triode part has potentials to issue electron beam current which is lower than 50% of maximum electron beam of said electron gun.

13. A cathode ray tube apparatus in accordance with claim 8, wherein potential of said additional grid is lower than 50% of the potential of said second grid.

14. A cathode ray tube apparatus comprising an electron gun for producing an electron beam along an axis, a fluorescent screen to be impinged by said electron beam and an evacuated enclosure enclosing said electron gun and said fluorescent screen therein, said electron gun comprising:

(a) a pre-triode part having a cathode, a first grid as a control grid and a second grid having a potential thereon and (b) a main lens part having a third grid, a fourth grid and a fifth grid as a final acceleration electrode, (c) an additional grid provided between said pre-triode and said main lens (d) means for impressing a potential on said additional grid which is lower than said potential of said second grid and is varied responding to degree of deflection of said electron beam to focus a substantial part of electrons emitted from said cathode toward said main lens in a manner that the electron gun axis is crossed twice, and trimming electrode means disposed in an inside hollow space of said fifth grid for trimming therethrough toward said fluorescent screen.

15. A cathode ray tube apparatus in accordance with claim 14, wherein electron beam passing apertures on said first grid and second grid and said additional grid have substantially the same diameters.

16. A cathode ray tube apparatus in accordance with claim 14, wherein a trimming apertures of said trimming electrode has a diameter which is about two times of said diameter of said electron beam passing aperture of said first grid.

17. A cathode ray tube apparatus in accordance with claim 14, wherein distance between said first grid and said second grid is 1.0–1.5 times diameter of said electron beam passing aperture of said first grid, distance between said second grid and said additional electrode is about the diameter of said electron beam passing aperture of said first grid, distance between said additional electrode and said third grid is 5–10 times diameter of said electron beam passing aperture of said first grid.

18. A cathode ray tube apparatus in accordance with claim 14, wherein electron beam permeability of said trimming electrode is 20–60%.

19. A cathode ray tube apparatus in accordance with claim 14, wherein said pre-triode part has potentials to issue electron beam current which is lower than 50% of maximum electron beam of said electron gun.

20. A cathode ray tube apparatus in accordance with claim 14, wherein potential of said additional grid is lower than 50% of the potential of said second grid.

* * * * *